United States Patent [19]

Dominguez

[11] Patent Number: 4,969,269

[45] Date of Patent: Nov. 13, 1990

[54] ELECTRICAL OUTLET CUTTER FOR WALLS PANELS

[76] Inventor: Armando Dominguez, 3467 SW. 3rd Ave., Miami, Fla. 33129

[21] Appl. No.: 286,107

[22] Filed: Dec. 19, 1988

[51] Int. Cl.[5] ..... B26F 1/00

[52] U.S. Cl. ..... 30/360; 30/362; 30/366; 83/685

[58] Field of Search ..... 30/305, 299, 165, 314, 30/315, 358, 360, 361, 362, 366; 83/685

[56] References Cited

U.S. PATENT DOCUMENTS

| | | | |
|---|---|---|---|
| 1,572,191 | 2/1926 | Donnelly | 30/305 |
| 1,817,223 | 8/1931 | Abramson et al. | 83/685 X |
| 3,273,241 | 9/1966 | Annes . | |
| 3,391,460 | 7/1968 | Moore | 30/366 X |
| 4,087,913 | 5/1978 | Jackson | 30/366 |
| 4,730,395 | 3/1988 | Blessing, Sr. | 30/360 |
| 4,796,361 | 1/1989 | Neal | 30/305 X |

*Primary Examiner*—Frank T. Yost
*Assistant Examiner*—Willmon Fridie, Jr.
*Attorney, Agent, or Firm*—J. Sanchelima

[57] ABSTRACT

A device for punching cutouts through sheets of drywall or similar wall covering sheets that are typically installed on framing members to which utility boxes are mounted. A cutting assembly is removably mounted over the utility or electrical boxes and the cutting assembly has substantially the same projected contour of these boxes with a puncturing member that cuts through the drywall. A pulling assembly engages with the protruding end of the puncturing member and adapted to pull it, and the cutting assembly to which it is rigidly connected, thereby producing a cutout that substantially follows the contour of the utility box that needs to be exposed through the drywall.

3 Claims, 5 Drawing Sheets

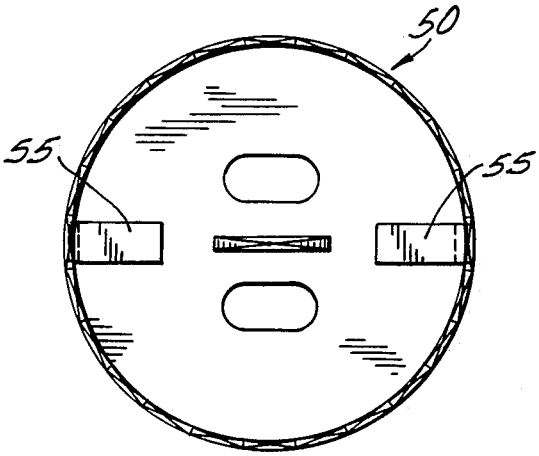
FIG. 3.
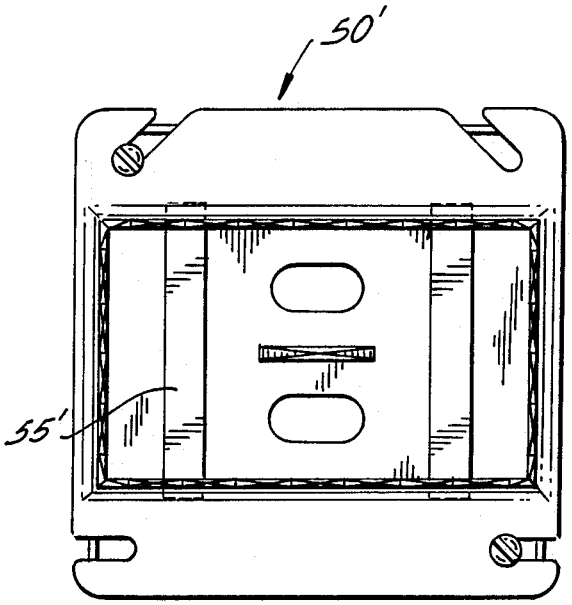
FIG. 5.
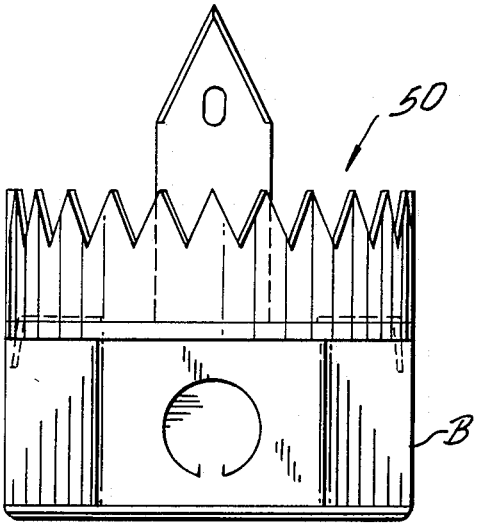
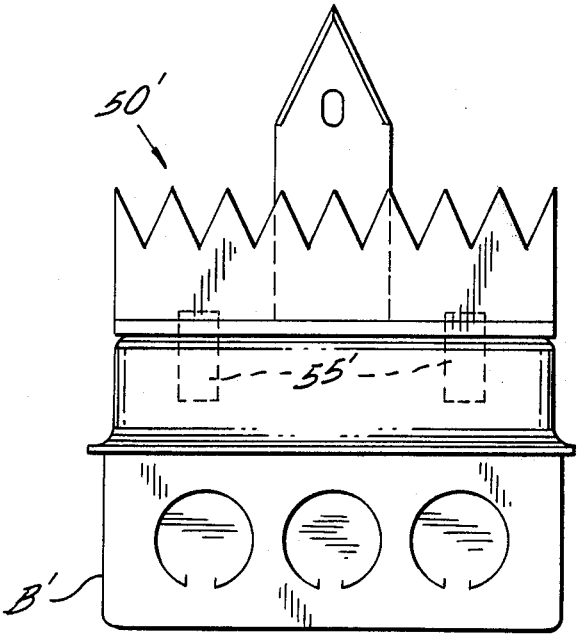

ELECTRICAL OUTLET CUTTER FOR WALLS PANELS

BACKGROUND OF THE INVENTION

1. Field of the Invention

The present invention relates to cutters for wall panels, and more particularly, to cutters for making the opening for conventional electrical boxes that need to protrude through the wall panels.

2. Description of the Related Art

The need for opening holes in wall panels in order to install the necessary electrical devices is well known. Conventional building practices usually involve the cutting of openings in wall panels, such as sheet rock panels, to position electrical boxes for AC outlets, switches, lamps and other devices. The installer needs to accurately measure the distance from reference points on the panel in order to locate the position of the box. Then, the installer needs to cut the opening approximating the contour of the box to be installed. Not infrequently, the opening does not match with the box being installed and finishing operation is necessary, i.e. caulking.

Applicant believes that the closest reference corresponds to U.S. Pat. No. 3,273,241 issued to T. Annes in 1966. The portable panel punching tool disclosed by Annes requires the use of a template to locate the position of the openings for the electrical boxes to be installed.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a tool for readily making openings for electrical boxes through sheets of sheet rock.

It is another object of this present invention to provide a tool that can make utility openings on sheet-rock with precision.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 3 illustrates a top view of a cutting assembly for conventional circular electrical boxes to be used in conjunction with the pulling tool assembly shown in FIG. 1.

FIG. 4 is a representation of the cutting assembly of FIG. 3 as seen from the side.

FIG. 5 shows a top view of a cutting assembly for conventional rectangular electrical boxes.

FIG. 6 illustrates the cutting assembly of FIG. 5 as seen from line 6—6.

DETAILED DESCRIPTION OF THE PREFERRED EMBODIMENT

Figure 1:
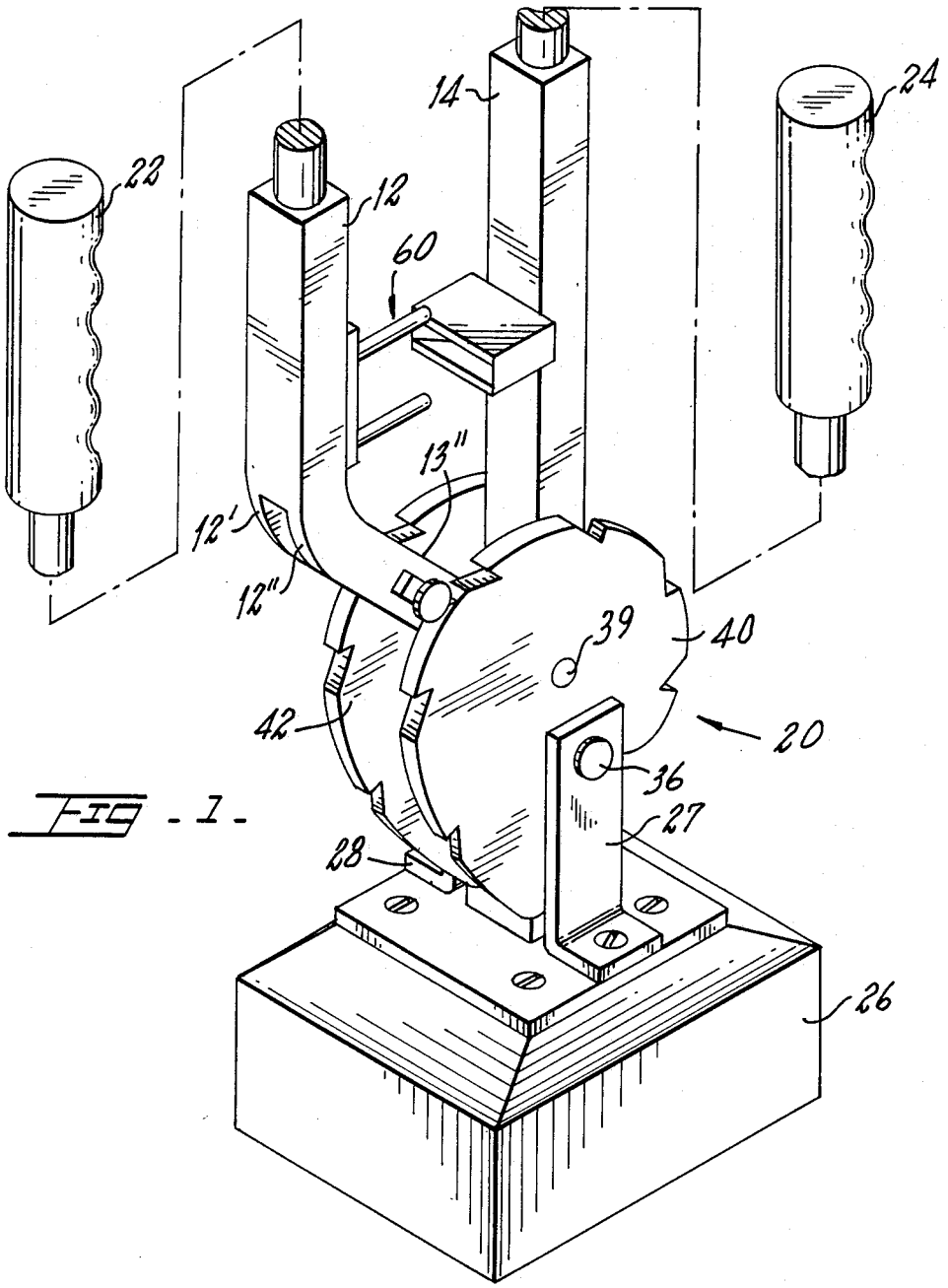
FIG. 1 represents the pulling tool assembly part of this invention, in perspective.

Referring now to the drawings, where the present invention is generally referred to with numerals 20 and 50, it can be observed that it consists of pulling tool assembly 20 and cooperating cutting assembly 50 or 50'. In FIG. 1, pulling tool assembly 20 is shown with handles 22 and 24 cut off from assembly 20 because of space limitations. Handles 22 and 24 are rigidly mounted to lever member 12 and post member 14. Lever 12 is an elongated rigid member of sufficient length to provide a comfortable torque to a user. Lever 12 bifurcates into arms 12' and 12" which journal shaft 39 at their ends. Upper walls 13' and 13" of arms 12' and 12" come in contact with detente surfaces 14' and 14" which limit the rotation of lever 12.

Cutting assembly 50 is represented in FIGS. 3 through 6 as corresponding to the conventional electrical boxes used today. Other styles with different variations may dictate modifications of the round electrical box cutting assembly 50 on the rectangular electrical box cutting assembly 50'. When referring to assembly 50, it is meant to also cover assembly 50' unless otherwise indicated.

Basically, the operation of the present invention consists of placing the appropriate cutting assemblies 50 on the AC outlet, switch or other electrical device requiring an electrical box. Sheet rock R is pushed or hammered carefully until puncturing member 52 protrudes through sheet rock R. Puncturing member 52 includes an opening 54 for engagement with a cooperating pin member 21 in pulling tool assembly 20, as described below.

Figure 2:
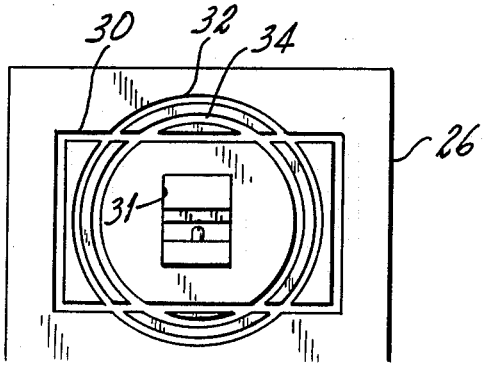
FIG. 2 shows a bottom view of the pulling tool assembly shown in FIG. 1.

In FIG. 1, pulling tool assembly 20 is represented in a perspective view, showing a base member 26 having, preferably, a substantially rectangular cross-section and a flat bottom surface. Base member 26 can be seen from the bottom in figure 2, including rectangular and circular channels 30; 32 and 34 that cooperate with the shape of cutting assemblies 50. Central through opening 31 has sufficiently large dimensions to allow puncturing member 52 through. Reinforcement plate 35 is rigidly mounted on top of base member 26 to further strengthen the mechanical integrity of base member 26 and to provide a mounting surface for the components of pulling tool assembly 20.

Support members 27 and 28 are rigidly mounted on top of plate member 35 and provide support to riveted pins 36 and 37 which have a threaded portion that engages into sleeve member 33.

Figure 7:
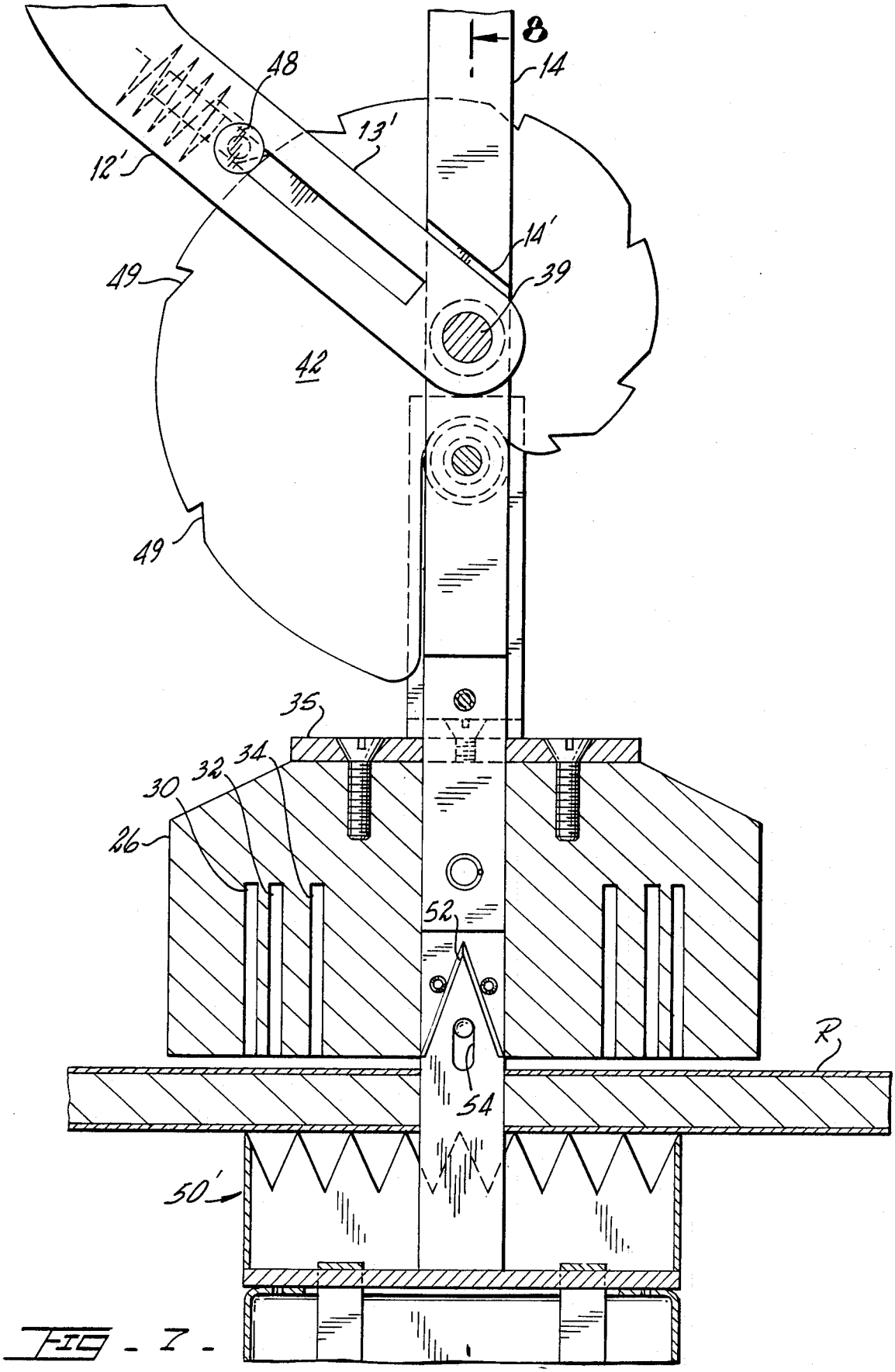
FIG. 7 is partial elevational side view of the tool assembly shown in FIG. 1 and the cutting assembly of FIGS. 5 and 6, as seen from line 7—7 in FIG. 1.
Figure 8:
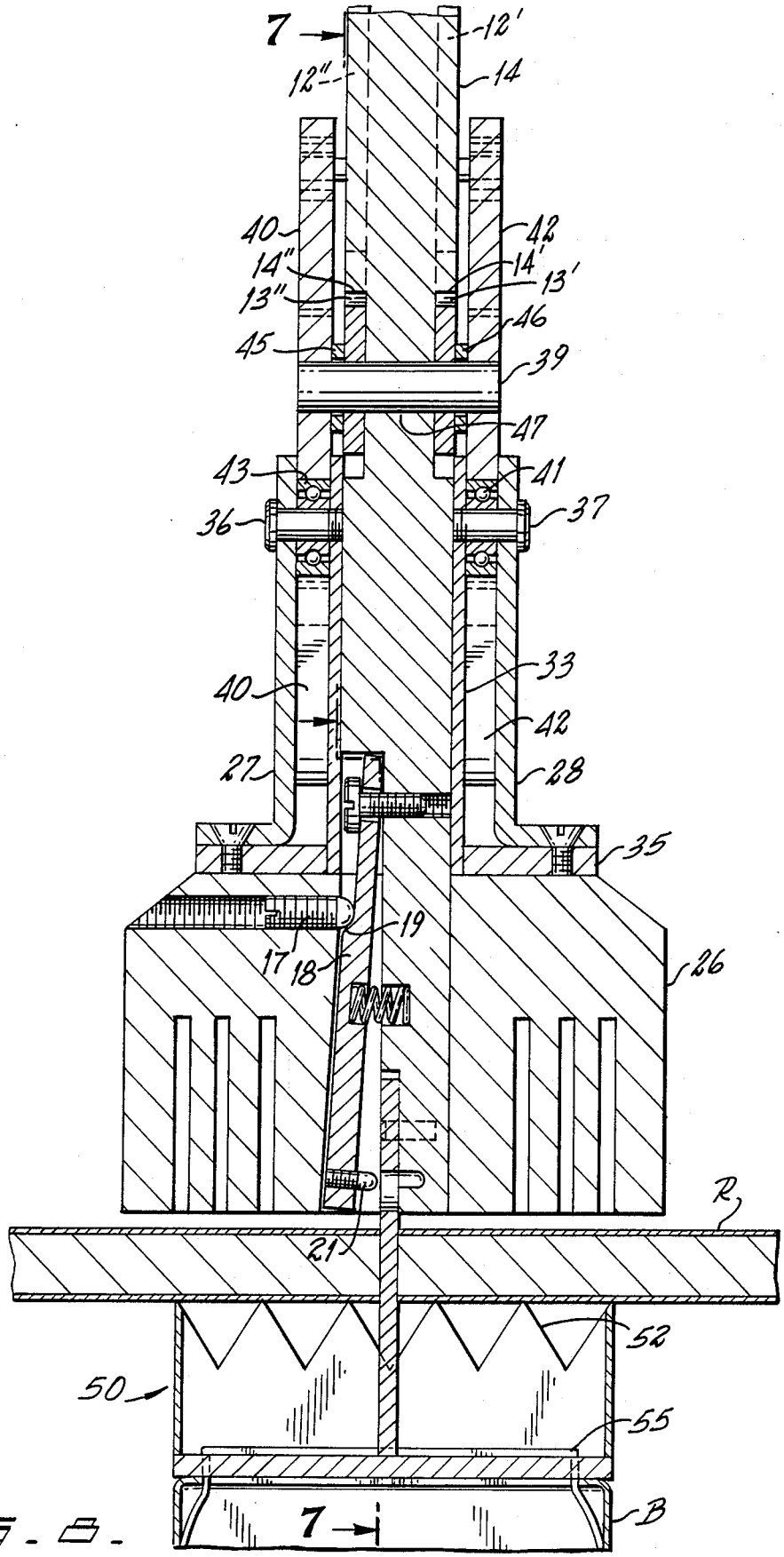
FIG. 8 is a part elevational front view of the tool assembly shown in FIG. 1 and the cutting assembly of FIGS. 5 and 6, as seen from line 8—8 in FIG. 1.
Figure 9:
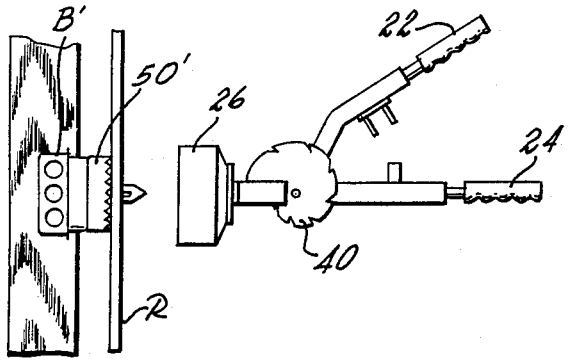
FIG. 9 through 14 illustrates the manner of operating the present invention, in sequence.
Figure 10:
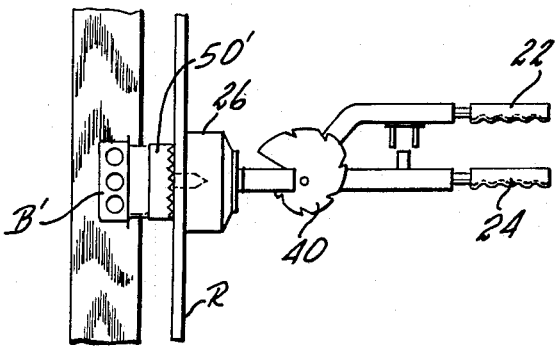
Figure 11:
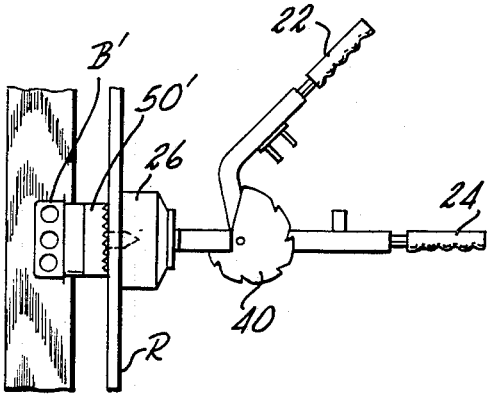
Figure 12:
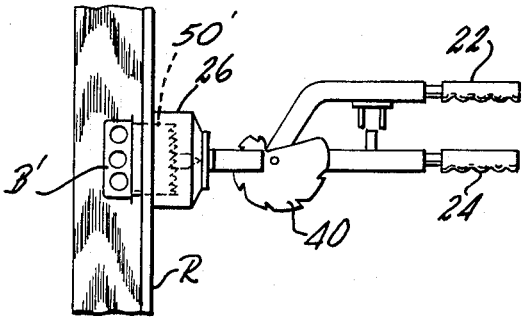
Figure 13:
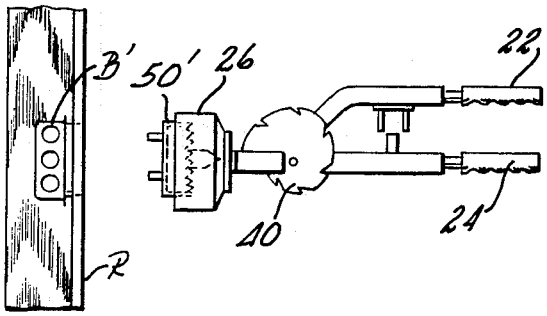

Camming gear members 40 and 42 are rigidly mounted on shaft 39, as shown in FIG. 1. Camming gear members 40 and 42 act on ball bearing member 41 and 43, respectively, pushing them downwarly as the diameter of gears 40 and 42 increases from a clockwise rotation in FIG. 7. The rotation of gear members 40 and 42 is caused by the force applied by the user to handle members 22 and 24 when urged towards each other. This force in turn is transmitted through arm member 12 which is pivotally mounted to shaft 39 which is turn is journalled by vertical arm member 14 at 47, as shown in FIG. 8. Locking washer members 45 and 46 are intended to prevent any movement of gear members 40 and 42 when arm member 12 moves counter-clockwise and some friction is imparted by spring loaded locking member 48 as it is in retracted position. When arm member 12 is rotated clockwise in FIG. 7, locking member 48 engages in one of a plurality of notches 49 causing gear members 40 and 42 to rotate clockwise. The edges of gears 40 and 42 in contact with ball bearings 41 and 43 are progressively farther away from their centers and, consequently, post member 14 slides upwardly through sleeve member 33. As post member 14 moves upwardly, spring loaded latching member 18 also moves up. Latching member 18 includes a camming surface 19 that in cooperation with the surface of the tip of set screw 17, causes pin member 21 to engage through opening 54 of puncturing member 52. Pulling cutting assembly 50 through sheet-rock R is easily accomplished by causing gear members 40 and 42 to rotate.

Once cutting assembly 50 cuts through sheet-rock R, the latter is brought towards electrical box B which is stationary since it is typically mounted to a wall frame member. As shown in FIGS. 3–6, cutting assemblies 50 and 50' are provided with tabs 55 and 55', respectively, that removably secure the cutting assemblies to the electrical boxes B and B'.

Figure 14:
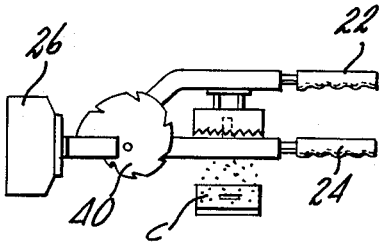

The sheet-rock cutout c that is lodged inside cutting assembly 50 is then easily removed by using cutout ejector assembly 60, shown in FIG. 14.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A device for punching cutouts through sheets of sheet-rock being installed on framing members that include electrical boxes rigidly mounted to said frame members, comprising;

A. cutting means mountable over said electrical boxes, having substantially the same projected contour of said boxes and including puncturing means rigidly mounted to said cutting means and perpendicularly disposed with respect to said sheets; and B. means for pulling said cutting means through said sheet-rock sheets having means for cooperatively engaging to said puncturing means after protruding through said sheet-rock sheet wherein said puncturing means are perpendicularly disposed with respect to the plane of said sheet-rock sheets and wherein said pulling means includes a base member having a substantially flat bottom surface and channels on said bottom surface that cooperatively house said cutting means protruding through said sheet, and further includes a through opening cooperatively disposed to allow said puncturing means through and wherein said pulling means includes a sleeve member vertically mounted over said base member and a cooperating post member slidably mounted through said sleeve member and said pose member having upper and lower ends and said lower end includes said means engaging said puncturing means.

2. The device set forth in claim 1 wherein said pulling means includes ratchet means for moving said post member upwardly with respect to said sleeve and base members.

3. The device set forth in claim 2 wherein said ratchet means includes at least one gear member rotably mounted to said post member and gear having a shape that provides for a camming action against a surface that is fixed and rigidly mounted to said base member so that said post member is slidably displaced upwardly as said gear is rotated.

* * * * *